US005791420A

United States Patent [19]

Budney

[11] Patent Number: 5,791,420

[45] Date of Patent: Aug. 11, 1998

[54] JAR ENHANCER

[76] Inventor: David Budney, 10732 - 45 Street, Edmonton, Alberta, Canada, T6A 1X7

[21] Appl. No.: 649,951

[22] Filed: May 16, 1996

[51] Int. Cl.[6] ..... E21B 31/107

[52] U.S. Cl. ..... 175/296; 175/321

[58] Field of Search ..... 175/296, 321; 166/178

[56] References Cited

U.S. PATENT DOCUMENTS

| | | | |
|---|---|---|---|
| 2,894,724 | 7/1959 | Andrew | 255/27 |
| 3,091,290 | 5/1963 | Clark, Jr. | 166/55 |
| 3,735,828 | 5/1973 | Berryman | 175/299 |
| 3,834,472 | 9/1974 | Perkins | 175/296 |
| 4,161,224 | 7/1979 | Hostrup | 175/297 |
| 4,200,158 | 4/1980 | Perkins | 175/297 |
| 4,361,195 | 11/1982 | Evans | 175/297 |
| 4,545,444 | 10/1985 | Webb et al. | 175/296 |
| 4,715,454 | 12/1987 | Teng et al. | 175/299 |
| 4,762,175 | 8/1988 | Perricone | 166/63 |
| 4,844,157 | 7/1989 | Taylor | 166/178 |
| 4,844,183 | 7/1989 | Evans | 175/296 |
| 4,846,273 | 7/1989 | Anderson et al. | 166/178 |
| 4,865,125 | 9/1989 | De Cuir | 166/178 |
| 5,033,557 | 7/1991 | Askew | 175/297 |
| 5,086,853 | 2/1992 | Evans | 175/297 |
| 5,139,086 | 8/1992 | Griffith, Sr. | 166/178 |
| 5,425,430 | 6/1995 | Roberts | 175/296 |
| 5,431,221 | 7/1995 | Roberts et al. | 166/73 |
| 5,447,196 | 9/1995 | Roberts | 166/178 |

FOREIGN PATENT DOCUMENTS 2072851 1/1993 Canada .

OTHER PUBLICATIONS

Abstract of U.S. Patent No. 5,174,393, issued Dec. 29, 1992.

*Primary Examiner*—Hoang C. Dang
*Attorney, Agent, or Firm*—Davis and Bujold

[57] ABSTRACT

A jar enhancer including a housing in which is telescopically mounted a mandrel, with the mandrel rotationally locked within the housing, and the housing and mandrel being spaced apart by an amount R at one location between them to form a chamber of width R. The upper end of the chamber is closed by a face, at least part of which is a shoulder extending inward from the housing, and the lower end of the chamber is closed by a face, at least part of which is a shoulder extending from the mandrel. The housing is sealed to the mandrel above and below the chamber and a port is provided for filling the chamber with compressible fluid. At least one of the shoulders has width W less than R, such that only a part of one of the faces bounding the chamber moves upon relative movement of the mandrel in relation to the housing. A second chamber of like design is provided in parallel with the first chamber to make a dual chamber, and in a still further jar enhancer, the dual chamber design has metallic springs rather than compressible fluid in the chambers and the shoulders need not occupy a portion of the end faces of the chamber.

3 Claims, 3 Drawing Sheets

JAR ENHANCER

FIELD OF THE INVENTION

This invention relates to jar enhancers, tools used for enhancing impacts delivered during downhole fishing operations.

BACKGROUND AND SUMMARY OF THE INVENTION

Roberts, U.S. Pat. No. 5,425,430 describes a jar enhancer in which upper and lower chambers in parallel are formed in an annulus between a mandrel and a housing. The mandrel and housing are arranged to reciprocate in relation to each other, without relative rotation. A compressible fluid occupies the chambers. Force exerted by or on the jar is distributed across the two chambers, thus resulting in lower internal pressures in the two chambers.

In the Roberts' patent, compressible fluid is compressed by a sealed sliding piston carried between the mandrel and housing. The piston face forms one end wall of the chamber, and thus as the piston moves into the chamber, compressing the compressible fluid, the entire end wall of the chamber moves, with maximal volume change of the chamber. The resulting chamber must therefore be made very long in order to provide a given amount of force.

In the present invention, the chambers are not closed by pistons, but by end walls of which only a portion moves to close the chambers and compress the fluid in the chambers. Hence, for a given length of movement of the mandrel in relation to the housing, a reduced volume is compressed, and for a given force, the volume of the chamber need be much less. Consequently, at the expense of an acceptable increase in pressure of the chambers, the tool may be made much shorter.

This result can be understood by considering that the volume of the chamber is proportional to the force to be exerted by the tool and the degree of relative movement of the mandrel and housing, and inversely proportional to the pressure of the compressible fluid, the compression ratio of the compressible fluid (which itself is a function of pressure) and the area of the chamber. Hence, for a given force, typically 20,000 lbs, and a typical relative displacement of the mandrel and housing, for example 10 inches, and a typical tool width (which largely controls the cross-sectional area of the chamber), the volume of the chamber is determined largely by the pressure. By reducing the moving portion of the end face of the chamber, for a given force, the pressure required is greater, and the chamber may be made much shorter.

The advantage supplied by this design may also be applied to jar enhancers with only one chamber. However, commercial use, in a confidential manner, has been made of the one chamber design in the United States for several years and is not claimed per se.

There is thus provided in accordance with one aspect of the invention, a jar enhancer including a housing in which is telescopically mounted a mandrel, with the mandrel rotationally locked within the housing, and the housing and mandrel being spaced apart by an amount R at one location between them to form a chamber of width R. The upper end of the chamber is closed by a face, at least part of which is a shoulder extending inward from the housing, and the lower end of the chamber is closed by a face, at least part of which is a shoulder extending from the mandrel. A second chamber of like design is formed between the mandrel and housing below the first chamber. The housing is sealed to the mandrel above and below the chambers and ports are provided for filling the chambers with compressible fluid. At least one of the shoulders in each chamber has width W less than R, such that only a part of one of the faces bounding the chambers moves upon relative movement of the mandrel in relation to the housing. Forces on the jar enhancer are thus distributed across the two chambers, with the resulting pressure less than half what it would otherwise be.

In a further jar enhancer, there is provided a mandrel, a housing surrounding the mandrel, the mandrel and housing being longitudinally movable with respect to each other, but rotationally locked with respect to each other; first and second downward facing shoulders on the housing; first and second upward facing shoulders on the mandrel spaced longitudinally from the first and second downward facing shoulders respectively; the mandrel and housing being spaced from each other by an amount R between the first downward facing shoulder and the first upward facing shoulder and between the second downward facing shoulder and the second upward facing shoulder respectively to form upper and lower chambers having radial thickness R; a first metallic spring disposed between the first upward facing shoulder and the first downward facing shoulder; and a second metallic spring disposed between the second upward facing shoulder and the second downward facing shoulder;

whereby force exerted by or on the jar enhancer is distributed across the first and second metallic springs.

These and other aspects of the jar enhancer are described below and claimed in the claims that follow.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1A:
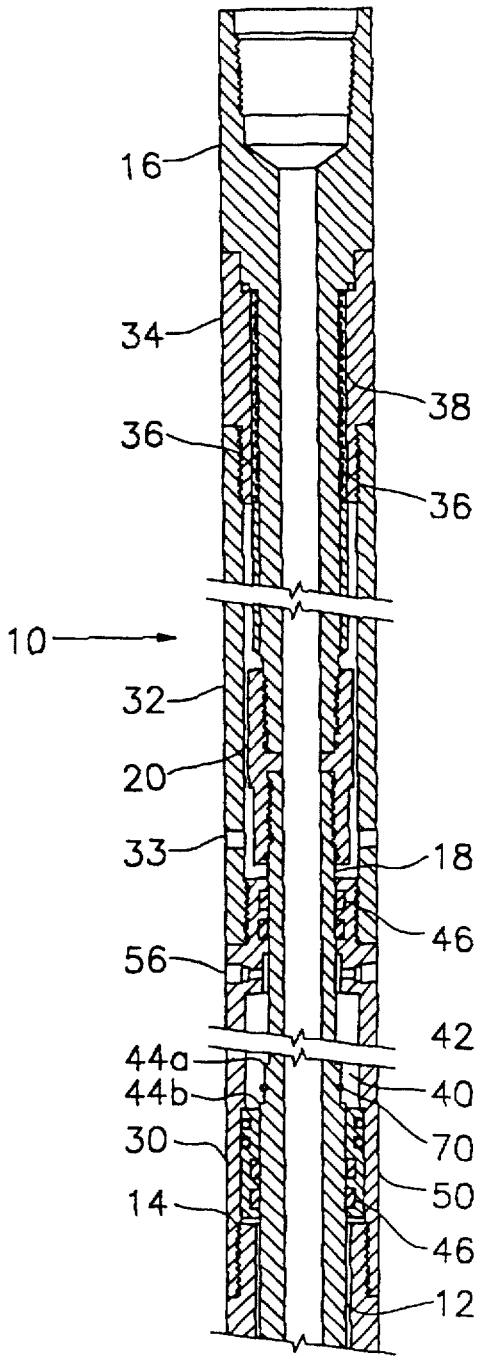
FIG. 1A is a section through a jar enhancer according to the invention showing an upper part of the jar enhancer.
Figure 1B:
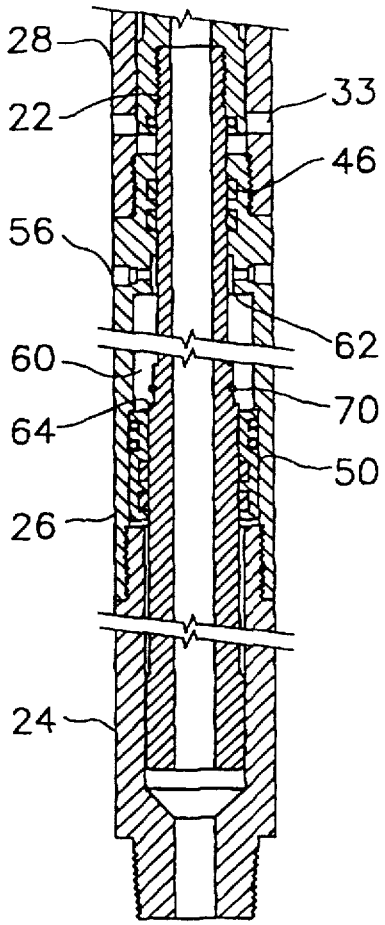
FIG. 1B is a section through a jar enhancer according to the invention showing a lower part of the jar enhancer.

Referring to FIGS. 1A and 1B, a jar enhancer 10 is shown that is formed of a mandrel 12 and a housing 14 surrounding the mandrel 12.

Starting at the top of the tool, the mandrel 12 includes a connector 16 adapted, as for example by being internally threaded, for connection in a tubing string (not shown). The connector end 16 is secured to a central pressure mandrel 18 through a connector sub 20, and the mandrel 12 terminates downward in a second pressure mandrel 22.

At the lower end of the housing 14 is formed a housing connector end 24 adapted, as for example by having exterior threads, for connection in a tubing string (not shown). In fact, the item next downward in the tubing string would typically be a fishing jar. Above the connector end 24 and threaded onto it is a lower body 26, and above the lower body 26 is a connector sub 28, followed by a middle body 30, a second connector sub 32 and a female spline body 34. The connector subs 28 and 32 may include ports 33 for allowing movement of mud in and out of the tool. It will be appreciated that the mandrel 12 and housing 14 are separated into parts for ease of manufacture, and various different ways of connecting the parts and several different divisions of the parts could be used.

Male splines 36 on the connector end 16 mate with female splines 38 on the female spline body 34, thus rendering the mandrel 12 and housing 14 longitudinally movable with respect to each other, but rotationally locked with respect to each other.

Figure 2:
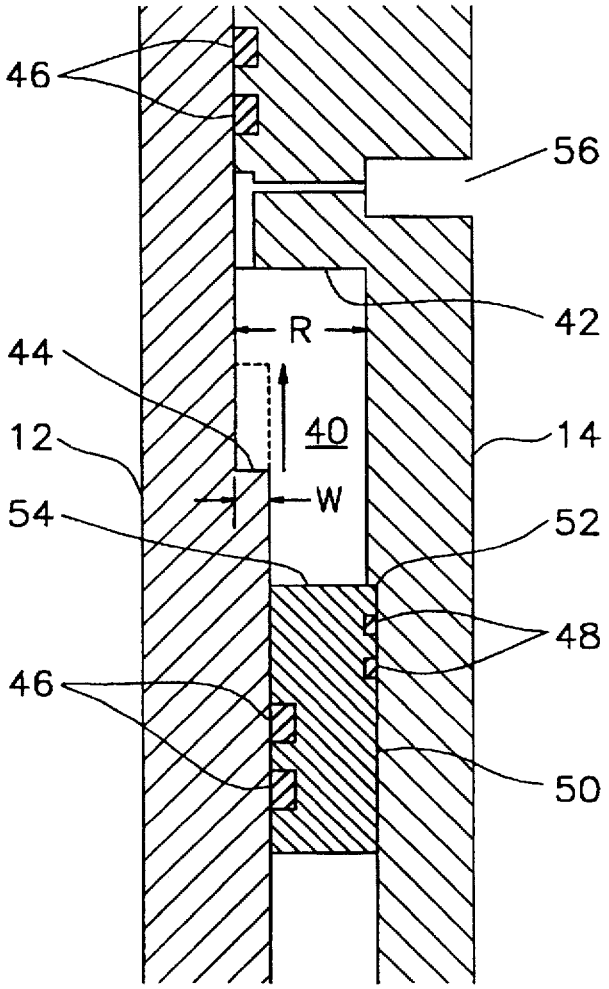
FIG. 2 shows how a chamber in the jar enhancer of FIGS. 1A and 1B closed.

Referring in addition to FIG. 2, which shows, schematically and not to scale, an enlarged view of a portion of the jar enhancer 10 including a chamber 40, the housing 14 has a first downward facing shoulder 42 which occupies the entire upper end face of the chamber 40. The mandrel 12 has a first upward facing shoulder 44 spaced longitudinally from the first downward facing shoulder 42. The mandrel 12 and housing 14 are spaced from each other by an amount R between the first downward facing shoulder and the first upward facing shoulder to form the chamber 40 having radial thickness R. Seals 46 and 48, and seal assembly 50, seal the housing 14 to the mandrel 12 above and below the chamber 40. Seal assembly 50 is prevented from upward movement with the mandrel 12 along the housing 14 by a shoulder 52. Face 54 and shoulder 44 together form an upward facing end face of the chamber 40. However, only shoulder 44 moves when the mandrel 12 moves upward along the housing 14. During operation the chamber 40 is filled with a compressible fluid, such as is commonly commercially available for use in downhole fishing tools. Filling of the chamber 40 is accomplished through means such as a port 56. A snap ring 70 may be used to punch out the seal assembly 50.

Shoulder 44 has a radial width W less than R. Preferably, W is less than one-half of R, preferably one-quarter R. While the chamber 40 is shown schematically in FIG. 2, the upward facing shoulder 44 of the chamber 40 shown in FIGS. 1A and 1B may be stepped and thus formed of shoulders **44*a* and 44*b*. The furthermost upward of the two chambers 44*a* and 44*b* should be spaced from the shoulder 42 by an amount sufficient to allow full travel of the mandrel 12 in relation to the housing 14**.

Lower chamber 60 is formed in like manner to chamber 40, with a second downward facing shoulder 62 and second upward facing shoulder 64, stepped in like manner to the shoulder **44*a*, *b*. The same seal assembly 50 and seals 46 and 48 are used for the lower chamber 60. Chambers 40 and 60 are formed in parallel so that loads across the jar enhancer 12** are distributed equally across both chambers.

It is not necessary that the lower end face of the chamber be the one that is split. The chambers 40 and 60 could in effect be inverted, so that the shoulders 42 and 62 extend only part of the way across the chamber, and the shoulders 44 and 64 extending all of the way across the chamber. In this embodiment, the seal assembly 50 must be secured against upward movement.

In an exemplary embodiment, the area of the shoulder 44 is 1.129 sq. in., and the area of the shoulder 42 is 5.105 sq. in. (R is 1 in.). For a typical force of 20,000 lbs, the pressure on the shoulder 44 is 17,715 psi. For a commercially available fluid, the compression ratio at this pressure is 8.3%. The volume displaced for a movement of the mandrel 10 in. in relation to the housing is 11.29 c.in. The volume of the chamber is then 136 c. in., giving a chamber length of 26.6 in. By comparison, for a similar chamber wherein shoulder 44 occupies the entire end face of the chamber, thus having an area of 5.105 sq. in., pressure on the shoulder is 3,917 psi, which for the same fluid results in a compression ratio of 2.5%. The volume of the displaced fluid is then 51.05 c.in., the volume of the chamber must then be 51.05× 100%/2.5% =2040 c.in. and the length of the chamber is 2040/5.105 =400 in., much more than the chamber length of 26.6 in. for this exemplary embodiment of the invention.

The use of this invention results in higher chamber pressures, which must of course be accommodated by the seals 46, 48. With commonly available seals, pressures in the order of 17,715 psi are readily accommodated with seals rated at 25,000 psi.

Figure 3A:
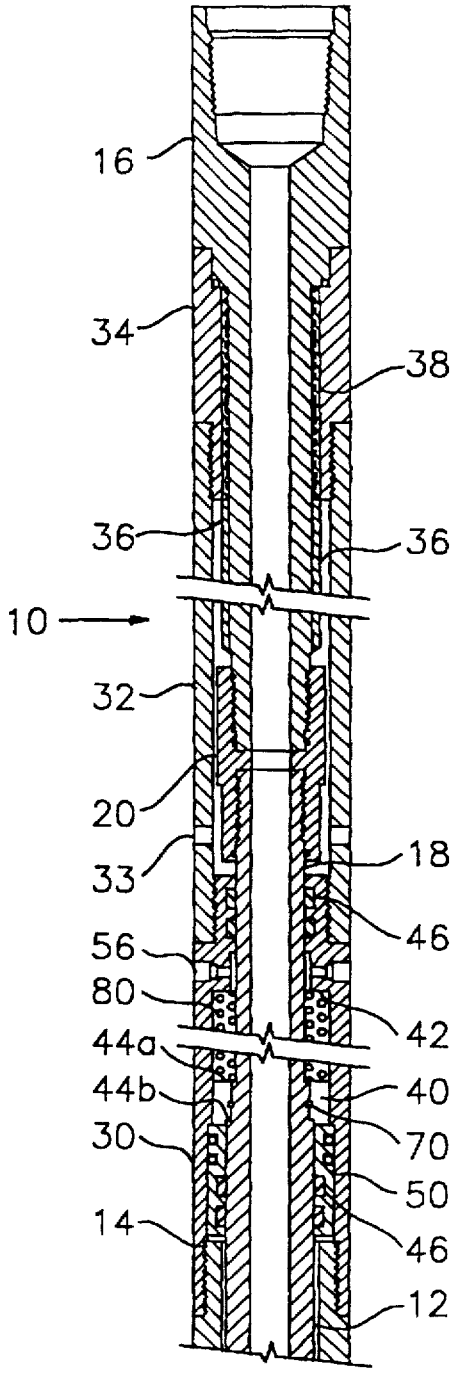
FIGS. 3A and 3B are sections showing a jar enhancer having spring sections in parallel.
Figure 3B:
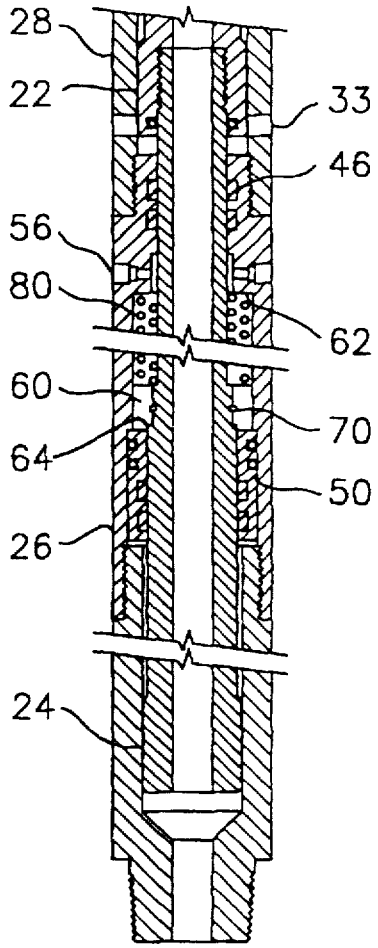

Another jar enhancer with distributed forces is shown in FIGS. 3A and 3B. The mandrel 12 and housing 14 for the embodiment of FIGS. 3A and 3B are the same as shown in FIGS. 1A and 1B except that the ports 56 may be omitted, and both sets of shoulders 42 and 44 and 62 and 64 may extend all the way across the chamber. In this instance, instead of filling the chambers 40 and 60 with fluid, Belleville™ springs 80 or similar metallic high tensile springs occupy the chambers 40 and 60 and are thus mounted in parallel. In the design shown in FIGS. 3A and 3B, the chambers 40 and 60 are still preferably sealed as shown or in like manner to help prevent corrosive fluids entering the chambers. The use of such metallic springs is, however, not desirable in highly corrosive environments such as in sour gas wells since the $H_2S$ tends to destroy the springs.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A jar enhancer, comprising:

a mandrel having a mandrel connector end adapted for connection in a tubing string;

a housing surrounding the mandrel, the housing having a housing connector end adapted for connection in a tubing string;

the mandrel and housing being longitudinally movable with respect to each other, but rotationally locked with respect to each other;

the housing being spaced from the mandrel at two longitudinally separate locations to form an upper chamber and a lower chamber;

the housing being sealed to the mandrel above and below each chamber;

means for filling each chamber with compressible fluid;

each chamber being bounded longitudinally by upper and lower end faces, one of the upper and lower end faces of each chamber being formed at least partly on the mandrel and the other of the upper and lower end faces of each chamber being formed at least partly on the housing, such that, in operation, upon relative longitudinal movement of the mandrel in relation to the housing fluid in the chambers may be compressed; and at least one of the upper and lower end faces of each chamber having a portion that moves with the mandrel and a portion that moves with the housing.

2. The jar enhancer of claim 1 in which the portions of the upper and lower end faces of each chamber that move with the mandrel are first and second shoulders on the mandrel that each occupy less than half of the spacing between the mandrel and the housing.

3. The jar enhancer of claim 2 in which the shoulders on the mandrel extend from the mandrel across about 25% of the spacing between the mandrel and the housing that forms the chambers.

* * * * *